US005856005A

United States Patent [19]

Gurian

[11] Patent Number: 5,856,005

[45] Date of Patent: Jan. 5, 1999

[54] PERMANENTLY ANTI-MICROBIAL AND FLAME-RETARDANT YARN AND FABRIC MADE THEREFROM

[75] Inventor: Martin E. Gurian, Ft. Lee, N.J.

[73] Assignee: Design Tex, Inc., New York, N.Y.

[21] Appl. No.: 656,948

[22] Filed: Jun. 6, 1996

[51] Int. Cl.[6] ..... D02G 1/18; D02G 1/16

[52] U.S. Cl. ..... 428/370; 428/400; 442/193; 442/197; 442/198; 442/308; 442/310; 57/207; 57/208; 57/246; 57/245; 57/227; 57/350; 57/905

[58] Field of Search ..... 428/370, 400; 57/207, 208, 246, 245, 227, 350, 905; 442/193, 197, 198, 308, 310

[56] References Cited

U.S. PATENT DOCUMENTS

| | | | |
|---|---|---|---|
| 4,000,551 | 1/1977 | Holden | 28/72.12 |
| 4,244,173 | 1/1981 | Lulay | 57/227 |
| 4,610,131 | 9/1986 | Eschenbach | 57/6 |

OTHER PUBLICATIONS

The abstract of JP06287811, Nov. 1994.
The abstract of DD253840, Feb. 1988.
Gruender, Michael, "New Acetate Works Against Bacteria," FW: Fiber Technology (Jan., 1996).

*Primary Examiner*—Kathleen Croi
*Attorney, Agent, or Firm*—Amster, Rothstein & Ebenstein

[57] ABSTRACT

A permanently flame-retardant and anti-microbial air-textured yarn is formed of a plurality of substantially longitudinally extending, permanently flame-retardant filaments defining a core, and a plurality of substantially randomly extending, permanently anti-microbial filaments disposed at least about the core, the anti-microbial filaments at least partially defining a boucle-like sheath about the core. A knit or woven fabric formed with the yarn and having at lease 5% by weight of the anti-microbial filaments is characterized by an ability to pass, both after one commercial laundering and after 100 commercial launderings, both National Fire Protection Agency vertical flame retardancy test NFPA 701-1989 and at least the 85% reduction level of gram positive and gram negative bacteria of anti-microbial test NYS 63.

26 Claims, 5 Drawing Sheets

PERMANENTLY ANTI-MICROBIAL AND FLAME-RETARDANT YARN AND FABRIC MADE THEREFROM

BACKGROUND OF THE INVENTION

The present invention relates to a permanently anti-microbial and flame-retardant yarn and fabric made therefrom, and more particularly to such a yarn having a unique construction.

There are few situations in which it would not be considered advantageous for a yarn to be flame-retardant. Similarly, there are few situations in which it would not also be considered desirable for such a flame-retardant fabric to also be anti-microbial (i.e., anti-bacterial, anti-fungal, anti-mildew, anti-mold, etc.). Among the many situations where it is important that a fabric exhibit both flame-retardant and anti-microbial characteristics are cubicle fabrics (that is, the privacy curtains used in hospital cubicles to separate one patient from another), shower curtains (where the anti-microbial feature retards the growth of mildew), draperies, bedspreads, etc. Perhaps the most difficult application of all is the cubicle fabric which must be capable of maintaining the desired flame-retardant and anti-microbial characteristics even after being subjected to numerous commercial launderings.

Among the most stringent and well-known tests for these characteristics are the National Fire Protection Agency (NFPA) vertical flame-retardancy test NFPA 701 (an 1989 version) and the anti-microbial test of NYS 63 for a percentage reduction level in the gram negative and gram positive bacteria. The vertical flame-retardancy test is specified by governmental authorities or contractors for many applications, and a fabric either passes the test or it does not. Typically, in order to meet the requirement, as a flame is brought close to a fabric, the fabric must undergo only a limited amount of burning. The anti-microbial test merely sets forth the test procedure to be used, allowing the manufacturer to specify the reduction level which is provided by a given fabric. A fabric which is to be used as a bandage, in actual contact with a wound, might require a very high bacteria reduction level of 99% or so (because it might be in contact with an open wound), while a cubicle fabric or shower curtain (which is not intended to be in contact with an open wound) may require only an 85% reduction level, or even less.

It is known both to produce a permanently flame-retardant yarn and to produce a permanently anti-microbial yarn. Nonetheless, the production of a yarn which is both permanently flame-retardant and permanently anti-microbial is not a simple matter. In order to produce the desired anti-microbial effect on bacteria (both gram positive and gram negative), fungus, mildew and the like, it is necessary that the anti-microbial material be present in at least a certain minimum local concentration. In other words, the dispersion of the anti-microbial material throughout a fabric may be ineffectual to fight microbes, while the disposition of the same quantity of anti-microbial material in or about a relatively small area of the fabric may be effective to provide an anti-microbial effect in at least that area. On the other hand, as one increases the amount of anti-microbial material, the effectiveness of the flame-retardant material is diminished. After a certain point, where the applicable flame-retardant test cannot be meet, this is simply unacceptable. In any case, the anti-microbial material is typically about three times as expensive as the flame-retardant material so that it is economically desirable to use the minimum amount of the anti-microbial material effective for a given application.

Accordingly, it is an object of the present invention to provide a permanently flame-retardant and anti-microbial yarn.

Another object is to provide such a yarn wherein, in one preferred embodiment, the anti-microbial filaments thereof are disposed so as to maximize the anti-microbial effect therefrom while minimizing both the cost thereof and the negative effect thereof on the flame-retardant filaments thereof.

A further object is to provide a knit or woven fabric formed with such a yarn.

It is also an object of the present invention to provide such a knit or woven fabric which, in one preferred embodiment, is characterized by an ability to pass, both after one commercial laundering and after 100 commercial launderings, both National Fire Protection Agency vertical flame-retardancy test NFPA 701-1989 (the 1989 version) and at least the 85% reduction level of gram positive and gram negative bacteria of anti-microbial test NYS 63.

SUMMARY OF THE INVENTION

It is has now been found that the above and related objects of the present invention are obtained in a permanently flame-retardant and anti-microbial yarn having a unique air-textured construction which provides a maximum effect for a minimum quantity of anti-microbial material without unduly impairing the flame-retardant character of the yarn. According to the present invention, the yarn is air-textured and comprises a plurality of substantially longitudinally extending, permanently flame-retardant filaments defining a core, and a plurality of substantially randomly extending, permanently anti-microbial filaments disposed at least about the core. The anti-microbial filaments at least partially define a boucle-like sheath about the core.

In a preferred embodiment the yarn comprises at least 10% (preferably 10–60%) by weight of the anti-microbial filaments and no more than 90% (preferably 40–90%) by weight of the flame-retardant filaments. The flame-retardant filaments are inherently flame-retardant polyester, and the anti-microbial filaments are cellulose acetate impregnated with an anti-microbial agent.

In an especially preferred embodiment, a plurality of substantially randomly extending permanently flame-retardant filaments are also disposed at least about the core.

The present invention also encompasses a knit or woven fabric formed with such yarn and comprising at least 5% by weight of the anti-microbial filaments. Such a fabric is preferably characterized by an ability to pass, both after one commercial laundering and after 100 commercial launderings, both National Fire Protection Agency vertical flame retardancy test NFPA 701-1989 and at least the 85% reduction level of gram positive and gram negative bacteria of anti-microbial test NYS 63.

Preferably the fabric closely simulates the appearance of a similar air-textured fabric consisting exclusively of permanently flame-retardant filaments of inherently flame-retardant polyester.

BRIEF DESCRIPTION OF THE DRAWING

The file of this patent contains at least one drawing executed in color. Copies of this patent with color drawings will be provided by the Patent and Trademark Office upon request and payment of the necessary fee.

The above brief description, as well as further objects, features and advantages of the present invention, will be more fully understood by reference to the following detailed description of the presently preferred, albeit illustrative, embodiments of the present invention when taken in conjunction with the accompanying drawing wherein:

Both FIGS. 4 and 5 are highly magnified and lined for contrasting color.

DETAILED DESCRIPTION OF THE PREFERRED EMBODIMENTS

Figure 1:
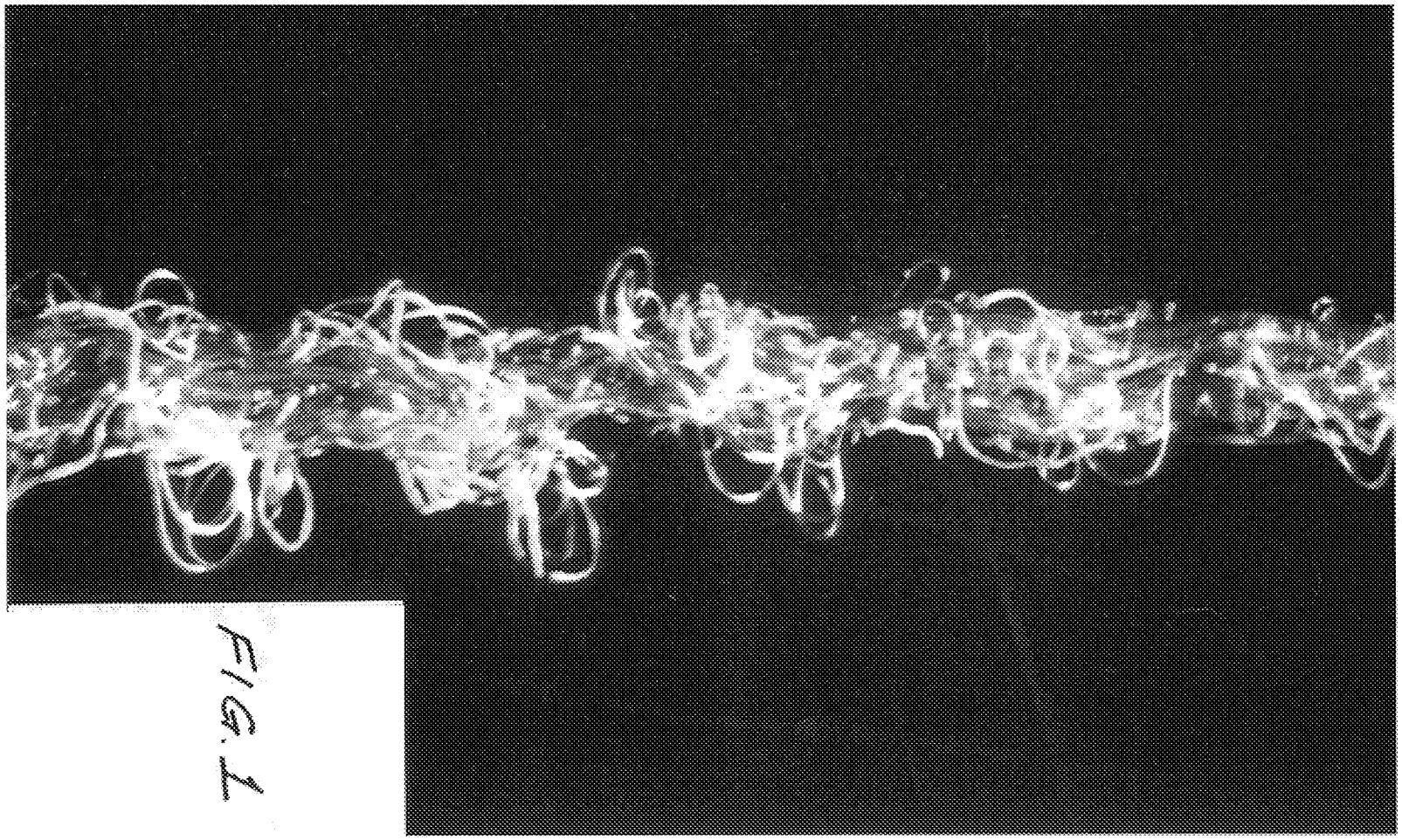
FIG. 1 is a fragmentary top plan view photomicrograph (at 15× magnification) of yarn according to the present invention.
Figure 2:
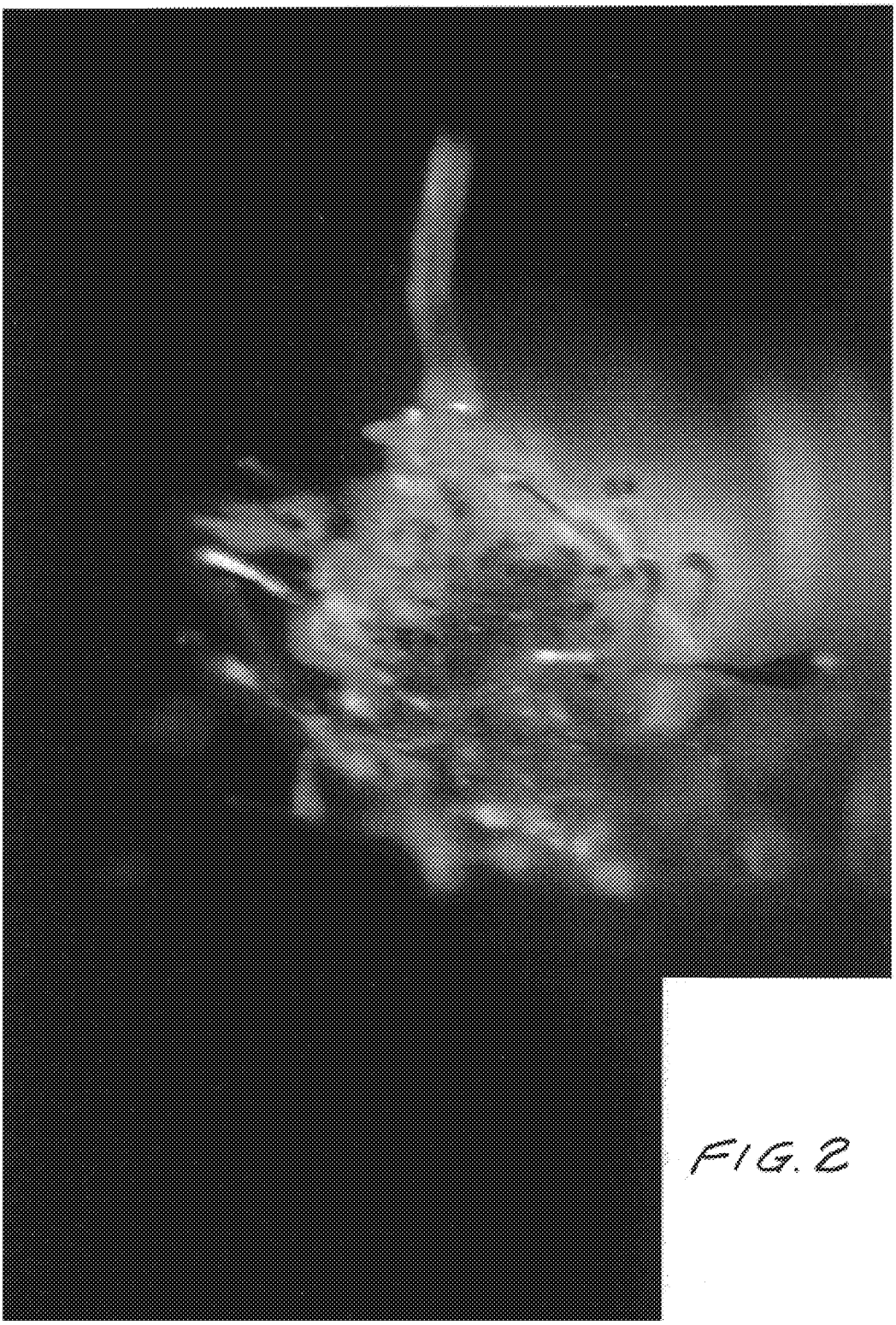
FIG. 2 is a sectional view photomicrograph (at 60× magnification) of the yarn.
Figure 4:
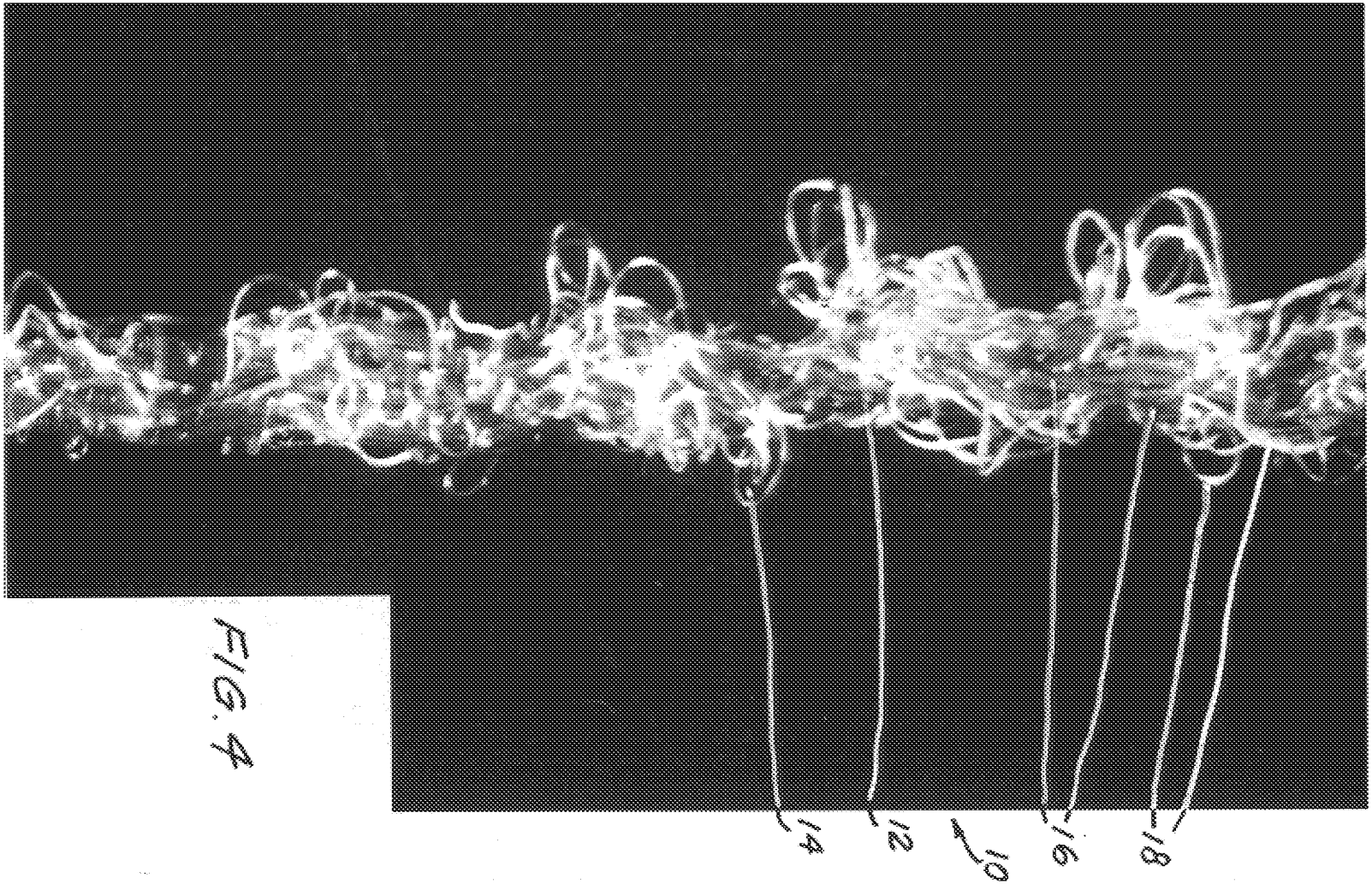
FIG. 4 is a fragmentary top plan view sketch of the yarn according to the present invention, similar to FIG. 1.

Referring now to the drawing, and in particular to FIGS. 1, 2 and 4 thereof, FIGS. 1 and 2 are photomicrographs of the permanently flame-retardant and anti-microbial air-textured yarn according to the present invention, generally designated by the reference numeral 10. The photomicrographs show a core 12 in blue and a boucle-like sheath 14 in blue and yellow about the core. The yarn 10 was made with especially dyed filaments to better indicate the contrast between the flame-retardant filaments 16 (blue) and the anti-microbial filaments 18 (yellow). The yarn 10 was co-air-textured with base filaments (which form the core 12) formed of a plurality of the permanently flame-retardant filaments 16 and a pair of effect filaments (which form the sheath 14)—one of the plurality of permanently flame-retardant filaments 16 and one of the plurality of permanently anti-microbial filaments 18. Yarns according to the present invention may have, about the plurality of substantially longitudinally extending filaments defining the core 12, any number of pluralities of substantially randomly extending filaments disposed about the core 12 to form at least partially a boucle-like sheath 14 about the core 12.

Thus, in the uniquely constructed yarn 10 of the present invention, there is both a plurality of substantially longitudinally extending, permanently flame-retardant filaments 16 defining a core 12 and a plurality of substantially randomly extending, permanently anti-microbial filaments 18 disposed at least about the core 12, the anti-microbial filaments 18 at least partially defining a boucle-like sheath 14 about the core 12. As illustrated in the highly preferred embodiment shown in the photomicrographs, the boucle-like sheath 14 is formed both by a plurality of substantially randomly extending permanently anti-microbial filaments 18 and a plurality of substantially randomly extending permanently flame-retardant filaments 16, the anti-microbial filaments 18 cooperating to at least partially define the boucle-like sheath 14 about core 12. The sheath 14 is boucle-like in that its outer surface appears to be formed mainly of a large number of miniloops of the anti-microbial filaments 18. It is theorized that the flame-retardant filaments 16 undergo a substantially higher level of shrinkage during the fabric-producing process relative to the anti-microbial filaments 18. Thus, the flame-retardant filaments 16 (including both those in the core 12 and those in the sheath 14) will shrink and bulk up, thereby forcing the unshrunk anti-microbial filaments 18 to bend back on themselves and form the loops defining the boucle-like sheath. At least some of the anti-microbial filaments 18 apparently extend through the core 12, and possibly some are in the core 12.

Figure 3:
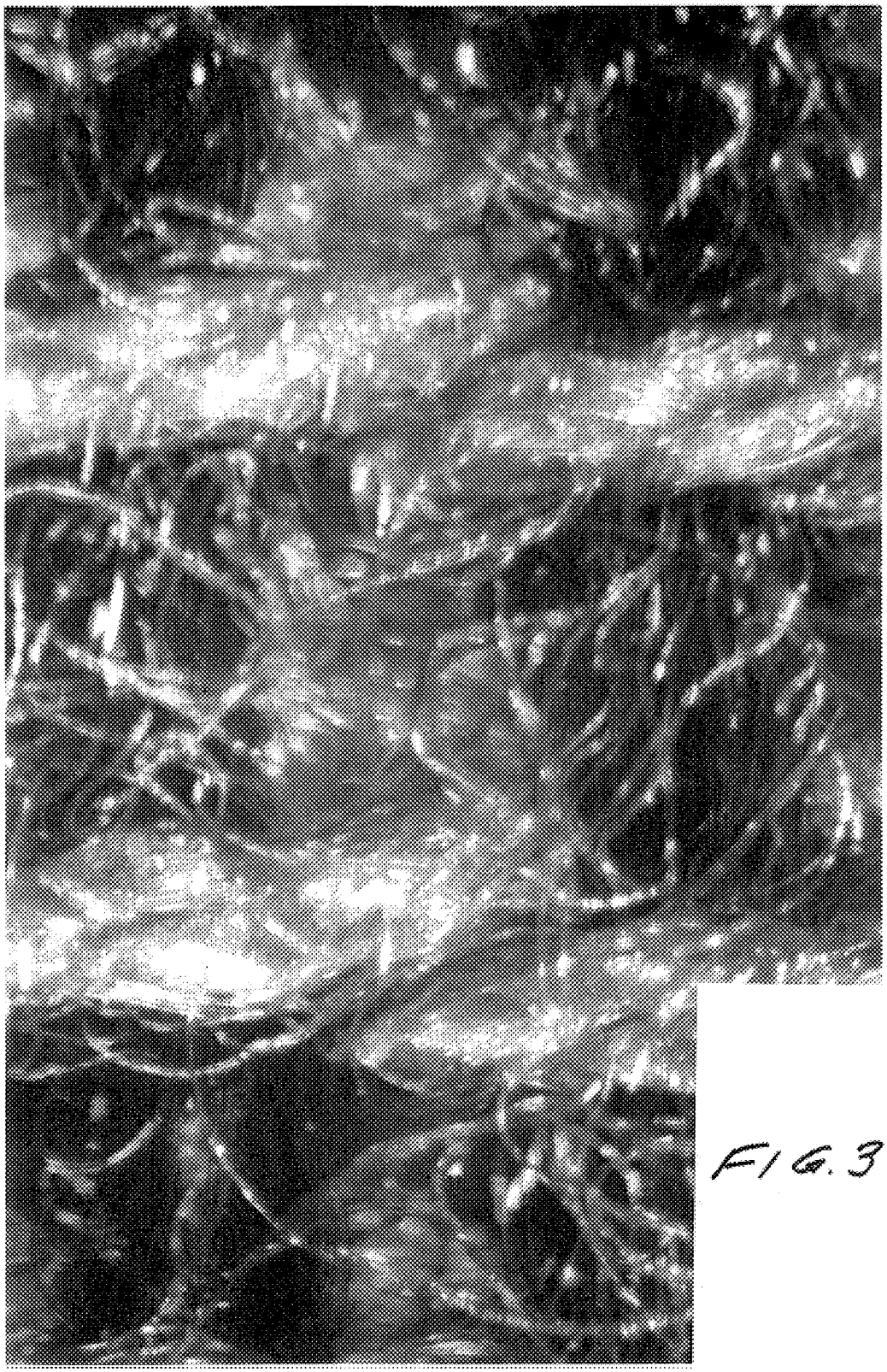
FIG. 3 is a fragmentary top plan view photomicrograph at 15× magnification of a fabric according to the present invention formed with the yarn.

The yarns preferably comprise at least 10% (and preferably 10–60%) by weight of the anti-microbial filaments 18 and no more than 90% (and preferably 40–90%) by weight of the flame-retardant filaments 16 (including those in the core 12 and those in the sheath 14). It is interesting to note that in the photomicrograph of FIG. 3 illustrating the fabric according to the present invention, generally designated 20, the yellow anti-microbial filaments 18 almost entirely conceal from view the blue flame-retardant filaments 16, even though the anti-microbial filaments 18 comprise only about 9% by weight of the fabric.

The anti-microbial filaments 18 are preferably formed of cellulose acetate permanently impregnated with up to 2% by weight of a chlorinated phenoxy compound available under the trade name MICROBAN B (from Morton Thiokol) as an anti-microbial agent. The MICROBAN B is a thin cell wall penetrant, not a systemic poison, and is registered with the FDA for use in fibers. The preferred anti-microbial filaments are available under the tradename MICROSAFE acetate (from Hoechst-Celanese). Certainly other permanently anti-microbial filaments capable of safely providing a fabric with the desired level of anti-microbial activity may be used instead. Interestingly, the anti-microbial filaments appear to achieve higher reduction levels in the anti-microbial test NYS 63 with an increasing number of commercial launderings at 160° F.

The flame-retardant filaments are preferably formed of an inherently flame-retardant polyester available under the tradename TREVIRA FR (from Hoechst-Celanese). Certainly other permanently flame-retardant filaments capable of providing a fabric with the desired amount of flame-retardancy may be used instead.

In the air (or air jet) texturing process, synthetic filament fiber (either partially oriented, fully oriented or a combination of the two) is overfed into the texturing unit. Here the fiber is subjected to a turbulent, high pressure "jet" of air that opens the fiber bundle, forms loops that create texture, and finally "locks" the structure together. The resultant yarn is then wound onto a yarn carrier for further specific processing (knitting, weaving, dyeing, etc.)

Air (or air jet) textured yarns are torque-free, uniform, free of the fly waste associated with spun yarns, highly abrasive-resistant and resilient. Due to the locked-down loop strucuture, they are also highly resistant to pilling. With an almost limitless combination of overfeeds and feed fibers, air jet textured yarns can be customized to create or mimic almost any tactile property that is desired.

Figure 5:
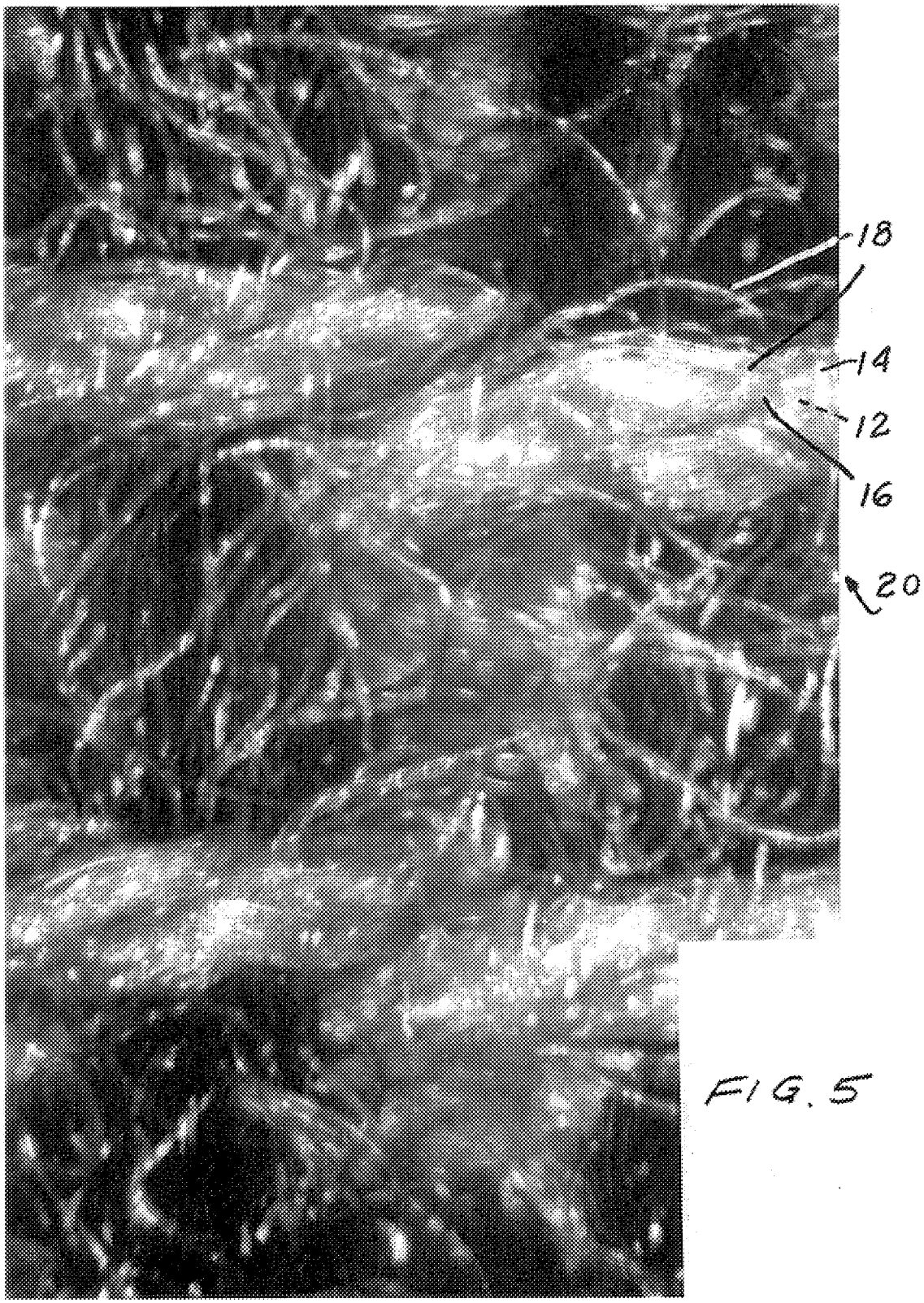
FIG. 5 is a fragmentary top plan view sketch of a fabric according to the present invention, similar to FIG. 3, formed with the yarn.

Referring now to the photomicrograph of FIG. 3 and to FIG. 5, therein illustrated is a knit or woven fabric according to the present invention, generally designated 20, a Jacquard woven fabric being shown. The fabric 20 comprises at least 5% by weight of the anti-microbial filaments 18, typically in the form of the yarn 10. It will be appreciated, of course, that the fabric 20 may be made either exclusively of the yarn 10 according to the present invention or by any combination of the yarn 10 of the present invention with other yarns, so long as the resulting fabric comprises at least 5% by weight of anti-microbial filaments 18. Thus the fabric may be woven having only alternate warp yarns formed of the yarn 10 or by having only particular woofs or fills formed of the yarn 10.

The fabric 20 according to the present invention is characterized by the ability to pass both flame-retardancy tests and anti-microbial tests, both after a single commercial laundering and after 100 commercial launderings (at 160° F.), the latter being intended to reflect the permanency of the flame-retardant and anti-microbial characteristics. The flame-retardancy test is preferably National Fire Protection Agency (NFPA) vertical flame-retardancy test NFPA 701-1989 (the 1989 version), both on the small scale and large scale levels of the test. The anti-microbial test is preferably NYS 63 at the 85% reduction level of gram positive bacteria and gram negative bacteria.

The fabric 20 according to the present invention closely simulates a similar air-textured fabric consisting exclusively of flame-retardant filaments of inherently flame-retardant polyester, such as that available under the tradename TREVIRA FR. The ability of the two yarns to mimic one another is advantageous in that both may be used in a given room and will appear to be the same fabric, even though those areas requiring an anti-microbial material may utilize the fabric 20 of the present invention and the remainder of the fabric may be formed of the cheaper, solely flame-retardant material. A further advantage is that a sample book need be provided with only one of the two materials (i.e., the solely flame-retardant material), thus avoiding the need for an interim update of the many costly sample books already in customer hands, with the latest fabric 20.

It is theorized that the unique air-texturing construction of the yarn 10 concentrates the anti-microbial filaments 18 in the sheath 14 of the yarn 10, where the anti-microbial activity is most urgently needed. On the other hand, the flame-retardant filaments 16, or at least a portion thereof, are concentrated in a substantially longitudinally extending core 12 of the yarn 10 and thus in an ideal position to provide the desired flame-retardant characteristic.

The following example illustrates the efficacy of the present invention in simultaneously achieving permanent flame-retardancy and permanent anti-microbial activity.

EXAMPLE

Three filament streams were fed into an air jet texturing machine (Model 335 Murata Jet Crimper) having a Heberlein HEMAJET LB02 air jet texturing body and a type T341W jet core. The core or base filament stream was 150/60 Hoechst-Celanese T692 SD (semi-dull) polyester, a form of TREVIRA FR. The first effect filaments were the same as the core filaments (but substantially randomly disposed) and the second effect filaments were 75/40 Hoechst-Celanese MICROSAFE cellulose acetate. The core filaments had a 8.62% overfeed, while the effect filaments had a 20.45% overfeed.

The yarn used in the fabric is 440/160 (440 denier/160 filaments) and formed of 79.26% polyester and 20.74% by weight cellulose acetate. The yarns are processed at a winding speed of 328 meters/minute to provide a product with a tenacity of 2.6 grams/denier Instron, an elongation of 26% (at break) Instron, and a wet shrinkage of 5% (hot water method, 190° F.).

The construction of the yarn thus formed was similar to that in the photomicrographs of FIGS. 1 and 2, while the construction of the fabric was similar to that in the photomicrograph of FIG. 3.

It should be appreciated that air-jet texturing is more an art than a science, and thus the particular settings of the machine set forth in the Example may not apply from one machine to another or even to the same machine at different times. Nonetheless, those persons skilled in the air-texturing art and familiar with a particular machine should be able to obtain the desired co-air-textured core/sheath structure with a minimum of experimentation.

A fabric according to the present invention made from 94% fire-retardant polyester (TREVIRA FR) and 6% anti-microbial acetate (MICROSAFE) was tested after receiving spaced separate inoculations with a gram positive bacteria (*Staphylococcus aureus*—ATCC6538 at a concentration of $3.6\times10^4$ CFU/0.2 ml), a gram negative bacteria (*Klebsiella pneumoniae*—ATCC 5352 at a concentration of $4.2\times10^4$ CFU/0.2 ml), and a fungus (*Aspergillus niger*—ATCC 6275 at a concentration of $3.0\times10^4$ CFU/0.2 ml). After 100 commercial laundering cycles at 160° F., the percentage reduction in the twenty-four organism count was 99.03% for the gram positive bacteria, 86.67% for the gram negative bacteria, and 44.44% for the fungus (five specimens being tested for each with the three middle values averaged). A similar test of a 91% fire-retardant polyester and 9% anti-microbial acetate fabric according to the present invention (after similar inoculations) showed a 99.72% reduction in the gram positive bacteria, a 99.76% reduction in the gram negative bacteria, and a 37.8% reduction in the fungus after 100 commercial launderings at 160° F.

To summarize, the present invention provides a permanently flame-retardant and anti-microbial yarn which, in one preferred embodiment, has the anti-microbial elements thereof disposed so as to maximize the anti-microbial effect therefrom, while minimizing both the costs thereof and the negative effect thereof on the flame-retardant filaments thereof. Also provided is a knit or woven fabric formed with such a yarn, which, in a preferred embodiment, is characterized by an ability to pass, both after one commercial laundering and after 100 commercial launderings, both vertical flame-retardancy test NFPA 701-1989 and at least the 85% reduction level of gram positive and gram negative bacteria of anti-microbial test NYS63.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A permanently flame-retardant and anti-microbial air-textured yarn, comprising:

(A) a plurality of substantially longitudinally extending permanently flame-retardant filaments defining a core; and (B) a plurality of substantially randomly extending permanently anti-microbial filaments disposed at least about said core, said anti-microbial filaments at least partially defining a sheath having a boucle appearance about said core.

2. The yarn of claim 1 comprising at least 10% by weight of said anti-microbial filaments and no more than 90% by weight of said flame-retardant filaments.

3. The yarn of claim 2 comprising 10–60% by weight of said anti-microbial filaments and 40–90% by weight of said flame-retardant filaments.

4. The yarn of claim 1 wherein said flame-retardant filaments are inherently flame-retardant polyester and said anti-microbial filaments are cellulose acetate impregnated with an anti-microbial agent.

5. A knit or woven fabric formed with the yarn of claim 1 and comprising at least 5% by weight of said anti-microbial filaments.

6. The knit or woven fabric of claim 5 characterized by an ability to pass, both after one commercial laundering and after 100 commercial launderings, both National Fire Protection Agency vertical flame retardancy test NFPA 701-1989 and at least the 85% reduction level of gram positive and gram negative bacteria of anti-microbial test NYS 63.

7. A knit or woven fabric formed with a permanently flame-retardant and anti-microbial air-textured yarn, comprising a plurality of substantially longitudinally extending permanently flame-retardant filaments defining a core, and a plurality of substantially randomly extending permanently anti-microbial filaments disposed at least about said core, said anti-microbial filaments at least partially defining a sheath having a boucle appearance about said core;

said fabric comprising at least 5% by weight of said anti-microbial filaments and being characterized by an ability to pass, both after one commercial laundering and after 100 commercial launderings, both vertical flame retardancy test NFPA 701-1989 and at least the 85% reduction level of gram positive and gram negative bacteria of anti-microbial test NYS 63.

8. The fabric of claim 7 characterized by closely simulating the appearance of a similar air-textured fabric consisting exclusively of permanently flame-retardant filaments of inherently flame-retardant polyester.

9. A process for forming a permanently flame-retardant and anti-microbial yarn, comprising the step of co-air-texturing:

(A) a plurality of substantially longitudinally extending permanently flame-retardant filaments defining a core, and (B) a plurality of substantially randomly extending permanently anti-microbial filaments disposed at least about the core, the anti-microbial filaments at least partially defining a sheath having a boucle appearance about the core.

10. The process of claim 9 wherein said yarn comprises at least 10% by weight of the anti-microbial filaments and no more than 90% by weight of the flame-retardant filaments.

11. The process of claim 10 wherein said yarn comprises 10–60% by weight of the anti-microbial filaments and 40–90% by weight of the flame-retardant filaments.

12. The process of claim 9 wherein the flame-retardant filaments are inherently flame-retardant polyester and the anti-microbial filaments are cellulose acetate impregnated with an anti-microbial agent.

13. The process of making a knit or woven fabric by knitting or weaving the fabric with the yarn of claim 1, the fabric comprising at least 5% by weight of the anti-microbial filaments and being characterized by an ability to pass, both after one commercial laundering and after 100 commercial launderings, both National Fire Protection Agency vertical flame retardancy test NFPA 701-1989 and at least the 85% reduction level of gram positive and gram negative bacteria of anti-microbial test NYS 63.

14. A permanently flame-retardant and anti-microbial air-textured yarn, comprising:

(A) a plurality of substantially longitudinally extending permanently flame-retardant filaments defining a core;

(B) a plurality of substantially randomly extending permanently flame-retardant filaments disposed at least through and about said core; and (C) a plurality of substantially randomly extending permanently anti-microbial filaments disposed at least about said core, said anti-microbial filaments at least partially defining a sheath having a boucle appearance about said core.

15. The yarn of claim 14 comprising at least 10% by weight of said anti-microbial filaments and no more than 90% by weight of said flame-retardant filaments.

16. The yarn of claim 15 comprising 10–60% by weight of said anti-microbial filaments and 40–90% by weight of said flame-retardant filaments.

17. The yarn of claim 14 wherein said flame-retardant filaments are inherently flame-retardant polyester and said anti-microbial filaments are cellulose acetate impregnated with an anti-microbial agent.

18. A knit or woven fabric formed with the yarn of claim 14 and comprising at least 5% by weight of said anti-microbial filaments.

19. The knit or woven fabric of claim 18 characterized by an ability to pass, both after one commercial laundering and after 100 commercial launderings, both National Fire Protection Agency vertical flame retardancy test NFPA 701-1989 and at least the 85% reduction level of gram positive and gram negative bacteria of anti-microbial test NYS 63.

20. A knit or woven fabric formed with a permanently flame-retardant and anti-microbial air-textured yarn, comprising:

(A) a plurality of substantially longitudinally extending permanently flame-retardant filaments defining a core;

(B) a plurality of substantially randomly extending permanently flame-retardant filaments disposed at least through and about said core; and (C) a plurality of substantially randomly extending permanently anti-microbial filaments disposed at least through and about said core, said anti-microbial filaments at least partially defining a sheath having a boucle appearance about said core;

said fabric comprising at least 5% by weight of said anti-microbial filaments and being characterized by an ability to pass, both after one commercial laundering and after 100 commercial launderings, both vertical flame retardancy test NFPA 701-1989 and at least the 85% reduction level of gram positive and gram negative bacteria of anti-microbial test NYS 63.

21. The fabric of claim 20 characterized by closely simulating the appearance of a similar air-textured fabric consisting exclusively of permanently flame-retardant filaments of inherently flame-retardant polyester.

22. A process for forming a permanently flame-retardant and anti-microbial yarn, comprising the step of co-air-texturing:

(A) a plurality of substantially longitudinally extending permanently flame-retardant filaments defining a core;

(B) a plurality of substantially randomly extending permanently flame-retardant filaments disposed at least through and about said core; and (C) a plurality of substantially randomly extending permanently anti-microbial filaments disposed at least through and about the core, the anti-microbial filaments at least partially defining a sheath having a boucle appearance about the core.

23. The process of claim 22 wherein said yarn comprises at least 10% by weight of the anti-microbial filaments and no more than 90% by weight of the flame-retardant filaments.

24. The process of claim 23 wherein said yarn comprises 10–60% by weight of the anti-microbial filaments and 40–90% by weight of the flame-retardant filaments.

25. The process of claim 22 wherein the flame-retardant filaments are inherently flame-retardant polyester and the anti-microbial filaments are cellulose acetate impregnated with an anti-microbial agent.

26. The process of making a knit or woven fabric by knitting or weaving the fabric with the yarn of claim 14, said fabric comprising at least 5% by weight of the anti-microbial filaments and being characterized by an ability to pass, both after one commercial laundering and after 100 commercial launderings, both National Fire Protection Agency vertical flame retardancy test NFPA 701-1989 and at least the 85% reduction level of gram positive and gram negative bacteria of anti-microbial test NYS 63.

* * * * *